United States Patent [19]

Bloker

[11] 4,114,655

[45] Sep. 19, 1978

[54] PROTECTIVE PLUG FOR THE ENDS OF TUBULAR CORES

[76] Inventor: Richard T. Bloker, 8224 Ammonett Dr., Richmond, Va. 23235

[21] Appl. No.: 697,619

[22] Filed: Jun. 18, 1976

[51] Int. Cl.[2] ..... F16L 55/10

[52] U.S. Cl. ..... 138/89; 138/98; 138/112

[58] Field of Search ..... 138/89, 98, 96 R, 96 T, 138/112, 113

[56] References Cited

U.S. PATENT DOCUMENTS 3,338,499 8/1967 Gilbert ..... 138/89

*Primary Examiner*—Richard E. Aegerter
*Attorney, Agent, or Firm*—Norman B. Rainer

[57] ABSTRACT

A cylindrical plug bounded by flat leading and trailing faces and fabricated of interadhered layers of annular sheets of corrugated paperboard is provided for use in protecting the ends of tubular cores employed for the winding of continuous elongated web or strand products. The plug contains a central hole adapted for engagement with core-handling equipment, and contains a water-impermeable coating. The layers of paperboard are cross-lapped for greater strength, and the leading face of the plug has a slightly reduced diameter to facilitate insertion into a tubular core.

4 Claims, 2 Drawing Figures

PROTECTIVE PLUG FOR THE ENDS OF TUBULAR CORES

BACKGROUND OF THE INVENTION

This invention relates to plugs adapted for insertion into the ends of hollow cores used for roll packaging elongated continuous material, and more particlarly to plugs useful in facilitating handling of tubular cores and in preventing physical damage to the ends of said cores.

A number of commercial products fabricated in elongated continuous form are generally packaged for storage, shipment and use in the form of a rolled winding on a cylindrical core. Elongated products commonly packaged in this manner include sheet or web structures such as paper, carpeting, plastic film and foam, knitted goods, woven cloth, laminated structures, and the like, and strand products such as cables, ropes, wires, cords, yarns, hoses, tubes, and the like.

The core is generally hollow or tubular in order to minimize the total weight of the package and is generally fabricated of inexpensive material such as paper to obviate the need for storage and/or return of the empty core. In the course of the usual industrial handling, the ends of the core, which in some package types protrude beyond the winding of material on the core, are exposed to conditions which may cause physical deformation, as by crushing or striking forces, or contact with water. Malformed ends of the cores can cause damage to the wound material, or may impair the ability of the wound material to properly unwind, or may prevent the proper mounting of the core on equipment to provide axial rotation for unwinding.

Specially designed fittings have been disclosed in the prior art for use in protecting the ends of tubes used for the packaging of wound continuous elongated products. One such fitting is the subject of U.S. Pat. No. 1,989,053 to Hills, et al, which relates to a protective device consisting of a flange attached to a plug, and a wrapping for the wound material, attached to the flange. Although the fitting of Hills, et al may afford a measure of protection for the ends of the tubes during shipment, the fittings must be removed during operations requiring the unwinding or use of the wound material. The Hills, et al fittings are also not compatible with present day methods for the lifting and moving of heavy tube packages. Such methods utilize lift trucks or other suitable equipment having clamping means which grip the ends of the tube by means of dowels which enter holes axially located in a flange or end plate of the tube.

The fittings of Hill, et al and other references are fabricated of corrugated paperboard because of the inherent stiffness, light weight, and low cost of this material. Because of the nature of many large scale manufacturing operations, it is generally expedient to utilize multiple layers of corrugated paperboard in a manner such that the direction of the corrugations or flutes is essentially the same in each layer.

It is an object of the present invention to provide protecting means for the ends of tubes used for the packaging of wound continuous elongated products wherein said protecting means facilitates the handling of said tubes by lift trucks and permits the mounting of said tubes on means for the unwinding of said wound products. It is another object to provide a protecting means for the ends of tubes used for forming packages of wound continuous elongated products wherein said packages containing said protecting means can be stacked on end and can be mounted on means for the unwinding of said wound products. Other objects and advantages will become apparent hereinafter.

SUMMARY OF THE INVENTION

The objects of the present invention are accomplished in general by providing a generally cylindrical plug fabricated of interadhered layers of corrugated paperboard wherein the direction of the corrugations of each layer of paperboard is aligned so as to cross at an angle of more than 30° with the direction of the corrugations of each contiguous layer. The plug is provided with an axial hole, and is chamfered at one end. The entire surface of the plug contains a water-impervious coating, having been applied preferably by immersion in a non-aqueous treating composition.

DETAILED DESCRIPTION OF THE INVENTION

Figure 1:
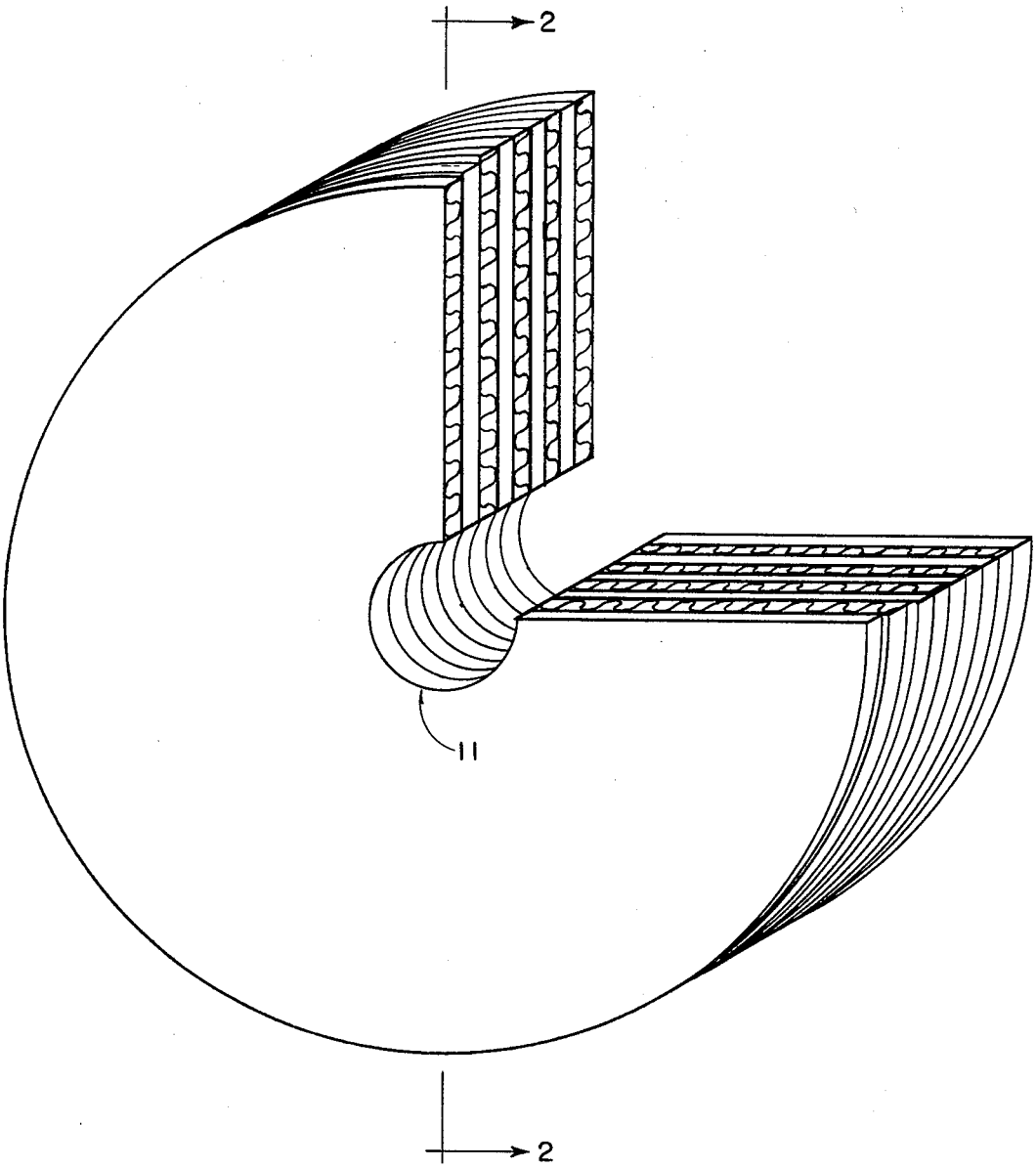
FIG. 1 is a perspective view of the tube plug of this invention with a section cut away to show internal structure.
Figure 2:
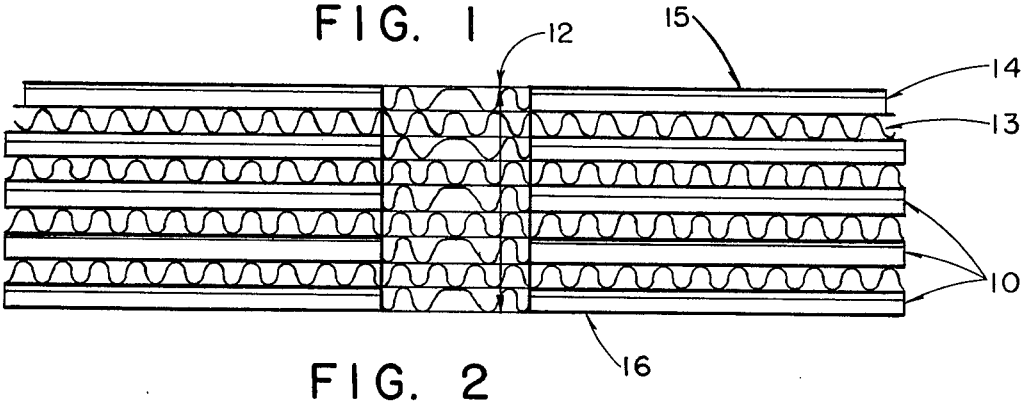
FIG. 2 is a sectional view taken along the line 2—2 of FIG. 1.

The roll plug illustrated in FIGS. 1 and 2 consists of a number of interadhered annular sheets of corrugated paperboard 10 having a circular periphery and a circular center hole 11. Each sheet of corrugated paperboard comprises a sinusoidally folded heavy gage paper adhesively sandwiched between two flat heavy gage paper surfaces. By virtue of the stacking of said sheets as layers, a circular channel 12 is formed. The two outermost layers, 13 and 14 at the leading face 15 have slightly smaller diameters in stepped relationship than the remaining layers of fiberboard. The purpose of the smaller diameter layers on said leading face 15 is to form a generally tapered or chamfered leading edge which will facilitate the entrance of the roll plug into a tight fitting tube. The extent of the chamfer is such that the top layer 14 on the leading face has a diameter about 1/10 inch smaller than the diameter of the interior layers 10.

The individual layers of paperboard, as shown in FIG. 2, are cross-lapped so that the direction of the flutes in a given layer is at an angle to the directions of the flutes of both contiguous layers. Although a cross-lapping angle of 90° is preferable, angles between 30° and 90° are found to provide acceptable results in terms of improving the rigidity of the structure. By way of comparison, plugs having the same configuration but having all layers aligned with flutes in the same direction, possess considerably less rigidity.

The diameter of the annular sheet layers 10 of the plug should be about 1/16 inch larger than the inside diameter of the tube the plug is intended to engage with. In this manner, the plug, when inserted, forms a strong frictional engagement with the tube, and cannot be accidentally dislodged. Removal of the plug can be achieved however by means of a special tool which will enter through the channel 12 and engage with leading face 15 to permit exertion of a strong pulling force.

The ratio of the diameter of the hole 11 to the diameter of the annular sheet layers is between 0.1 and 0.4, and preferably between 0.2 and 0.3. Various thicknesses and grades of corrugated paperboard may be employed as the annular sheet layers, and in fact remnant or scrap paperboard may be utilized which might otherwise be considered waste material.

The individual layers of the paperboard are bonded together by a water-based type of adhesive such as casein, dextrin, starch, sodium silicate, or synthetic polymer latexes such as polyvinylacetate, polyvinylchloride, polystyrene-butadiene, and acrylic latexes. The adhesive may be applied either to 100% of the contacting paperboard surfaces, or the adhesive may be applied in stripes, covering as little as 40% of the surfaces.

The water impervious coating is applied preferably from a non-aqueous liquid vehicle in order to avoid distortion and softening of the paperboard and possible delamination by contact with a large quantity of water. The material employed to form the water impervious coating is preferably a non-tacky wax-like material having a softening point above 120° F. Suitable materials include hydrophobic natural and synthetic waxes; polymers and copolymers derived from ethylene, styrene, vinylacetate, vinylchloride and acrylonitrile; hydrocarbon resins; terpenoid resins; and other similar materials and mixtures of the aforesaid materials. The waxlike material is applied in the form of a liquid comprising either a molten form of the waxlike material or a solution thereof in a suitable solvent. Low viscosity fluid compositions are preferable in order to secure better contact with all exposed surfaces.

The water-impervious coating is applied in a manner so as to cover all exposed surfaces of the plug, and particularly the channel 12 and external peripheral edges of the layers. This is best accomplished by a dipping operation wherein the plug is immersed in the fluid treating composition and then removed. To facilitate greater impregnation, the dipping may be carried out at reduced pressure, thereby causing better entrance of the treating fluid into pores or other confined regions. The total add-on of the water-impervious coating is between 10% and 30% of the total weight of the finished product.

In certain embodiments of the invention, the water impervious coating may be provided by means of a heat-shrinkable film such as polyvinylchloride. In treatments of such nature, the otherwise completely fabricated plug is wrapped with a close-fitting shrinkable film, and the assembly is then placed in a uniformly heated chamber. A vacuum is preferably drawn from within the plug to ensure good contact of the film with the plug. Supplementary treatment with the aforementioned wax-like material may also be utilized.

The number of layers of paperboard utilized in fabricating the plug is chosen so as to provide an adequate total thickness. The total thickness, namely the distance between the leading face 15 and trailing face 16 is such that the ratio of thickness to outside diameter is between about 0.25 and 1.0. Smaller ratios result in plugs of inadequate strength and rigidity, whereas plugs having larger ratios become difficult to insert into tubes and represent additional weight without providing additional protection for the end of the tube.

In the general manner of fabricating the plug of this invention, it is preferable that the separate annular sheets of corrugated paperboard are first cut to appropriate size, then glued and assembled. It is preferable that no cutting or other machining steps are carried out on the once assembled plug structure.

Having thus described my invention, I claim:

1. A cylindrical plug bounded by flat leading and trailing faces and fabricated of interadhered layers of annular sheets of corrugated paperboard wherein the direction of the corrugations of each layer is aligned so as to cross at an angle of 30° to 90° with the direction of the corrugations of each contiguous layer, said plug being provided with an axial cylindrical hole the ratio of the diameter of said hole to the diameter of said plug being between 0.2 and 0.3, the layer which constitutes said leading face having a smaller diameter than the diameters of subsequent layers, and the entire external surface of said plug containing a water-impervious coating.

2. The plug of claim 1 wherein said sheets of paperboard are interhered by means of a water-based type of adhesive.

3. The plug of claim 1 wherein the layer next adjacent to the layer which constitutes the leading face has a diameter greater than the diameter of said leading face layer but smaller than the diameter of subsequent layers.

4. The plug of claim 3 wherein said water-impervious coating has been applied by immersion of said plug in a non-aqueous fluid composition which deposits a wax-like material having a softening point above 120° F.

* * * * *